US007906740B2

(12) United States Patent
Gopikrishnan Babu et al.

(10) Patent No.: US 7,906,740 B2
(45) Date of Patent: Mar. 15, 2011

(54) READINESS FOR CLOSING INDICATOR FOR CIRCUIT BREAKERS

(75) Inventors: Triplicane Gopikrishnan Babu, Andhra Pradesh (IN); Janakiraman Narayanan, Andra Pradesh (IN); Mahesh Jaywant Rane, Secunderabad (IN); Simhadri Ramalingeswara Rao Gupta, Andhra Pradesh (IN); Yatin Vilas Newase, Maharashtra (IN)

(73) Assignee: General Electric Company, Schenectady, NY (US)

( * ) Notice: Subject to any disclaimer, the term of this patent is extended or adjusted under 35 U.S.C. 154(b) by 254 days.

(21) Appl. No.: 12/103,056

(22) Filed: Apr. 15, 2008

(65) Prior Publication Data

US 2009/0256660 A1 Oct. 15, 2009

(51) Int. Cl.
*H01H 5/00* (2006.01)

(52) U.S. Cl. ..... 200/400; 200/401

(58) Field of Classification Search ..... 200/400
See application file for complete search history.

(56) References Cited

U.S. PATENT DOCUMENTS 4,146,765 A * 3/1979 Wilson ..... 200/400
4,409,449 A * 10/1983 Takano et al. ..... 200/400
4,491,709 A * 1/1985 Chabot et al. ..... 200/400
5,408,208 A * 4/1995 DiMarco et al. ..... 335/14
5,673,786 A * 10/1997 Seymour et al. ..... 200/308
6,072,136 A * 6/2000 Wehrli et al. ..... 200/401
6,080,947 A 6/2000 Ulerich
6,144,002 A 11/2000 Coudert et al.
6,788,172 B1 9/2004 Godesa et al.
6,803,535 B1 * 10/2004 Whipple et al. ..... 200/308

FOREIGN PATENT DOCUMENTS

EP 2015337 A 1/2009

OTHER PUBLICATIONS

EP Search Report issued in connection with corresponding EP Patent Application No. 09157296 filed on Apr. 3, 2009.

* cited by examiner

*Primary Examiner* — Renee S Luebke
*Assistant Examiner* — Lisa Klaus
(74) *Attorney, Agent, or Firm* — Global Patent Operation; Stephen G. Midgley

(57) ABSTRACT

Disclosed is a visual and electrical indication on the status of "Readiness to close" (RTC) for circuit breakers. Exemplary embodiments include a circuit breaker apparatus, including a lay shaft coupled to circuit breaker contacts, a lay shaft cam profile coupled to the lay shaft, a trip free plate coupled to the lay shaft cam profile, a trip paddle coupled to the trip free plate, wherein the trip paddle is coupled to a trip shaft and a ready to close indicator coupled to the trip free plate and charging cam assembly.

6 Claims, 11 Drawing Sheets

READINESS FOR CLOSING INDICATOR FOR CIRCUIT BREAKERS

BACKGROUND

The subject invention relates to circuit breakers, and more particularly the subject invention relates to an indicator that indicates a visual and electrical indication on the status of "Readiness to close" (RTC) for circuit breakers.

A circuit breaker is an automatically-operated electrical switch designed to protect an electrical circuit from damage caused by overload or short circuit. Unlike a fuse, which operates once and then has to be replaced, a circuit breaker can be reset (either manually or automatically) to resume normal operation. A switch mechanism of the breaker can then be thrown to open and close contacts to which the load is connected.

As such, a circuit breaker may be in different states, in particular a closed state with closing springs energized, a closed state with closing spring not energized, an open state with closing springs energized, an open state with closing spring not energized, an open state with any interlock applied condition, and an open state with any interlocks not applied. For a circuit breaker to close the contacts, the following conditions to be met: the closing spring should be energized, the breaker contacts should be in open state, and interlock should not be applied.

It is desirable to monitor this status (readiness to closing) through an indicator, which will help the customer to know the circuit breaker "ready to close" status easily.

BRIEF DESCRIPTION OF THE INVENTION

Further exemplary embodiments include a circuit breaker system, including a circuit breaker having circuit breaker contacts and a closing spring, the closing spring operatively coupled to a charging cam assembly, a lay shaft coupled to the circuit breaker contacts, a lay shaft cam profile coupled to the lay shaft, a trip free plate coupled to lay shaft cam profile, a trip paddle coupled to the trip free plate, the trip paddle being coupled to a trip shaft and a ready to close indicator coupled to the trip free plate and a charging cam assembly.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Exemplary embodiments provide indication of "ready to close" for a circuit breaker in response to all of the following conditions of the circuit breaker being satisfied: 1) the circuit breaker main spring is charged; 2) the shunt coil is not energized; 3) the UV coil if installed is energized; 4) the circuit breaker is not locked in OFF position by any of the provided locking/interlock means; 5) the circuit breaker is in OFF position; and 6) the mechanical lockout in the protection unit assembly is reset. If any one or more of the above conditions are not satisfied the indicator as described herein does not indicate "ready to close". In exemplary embodiments, the indication can be a visible flag showing "Readiness to close status" or an electrical signal. The interlock application may be either through energizing shunt coils, not energizing under voltage coils, application of padlock/key lock.

Figure 1A:
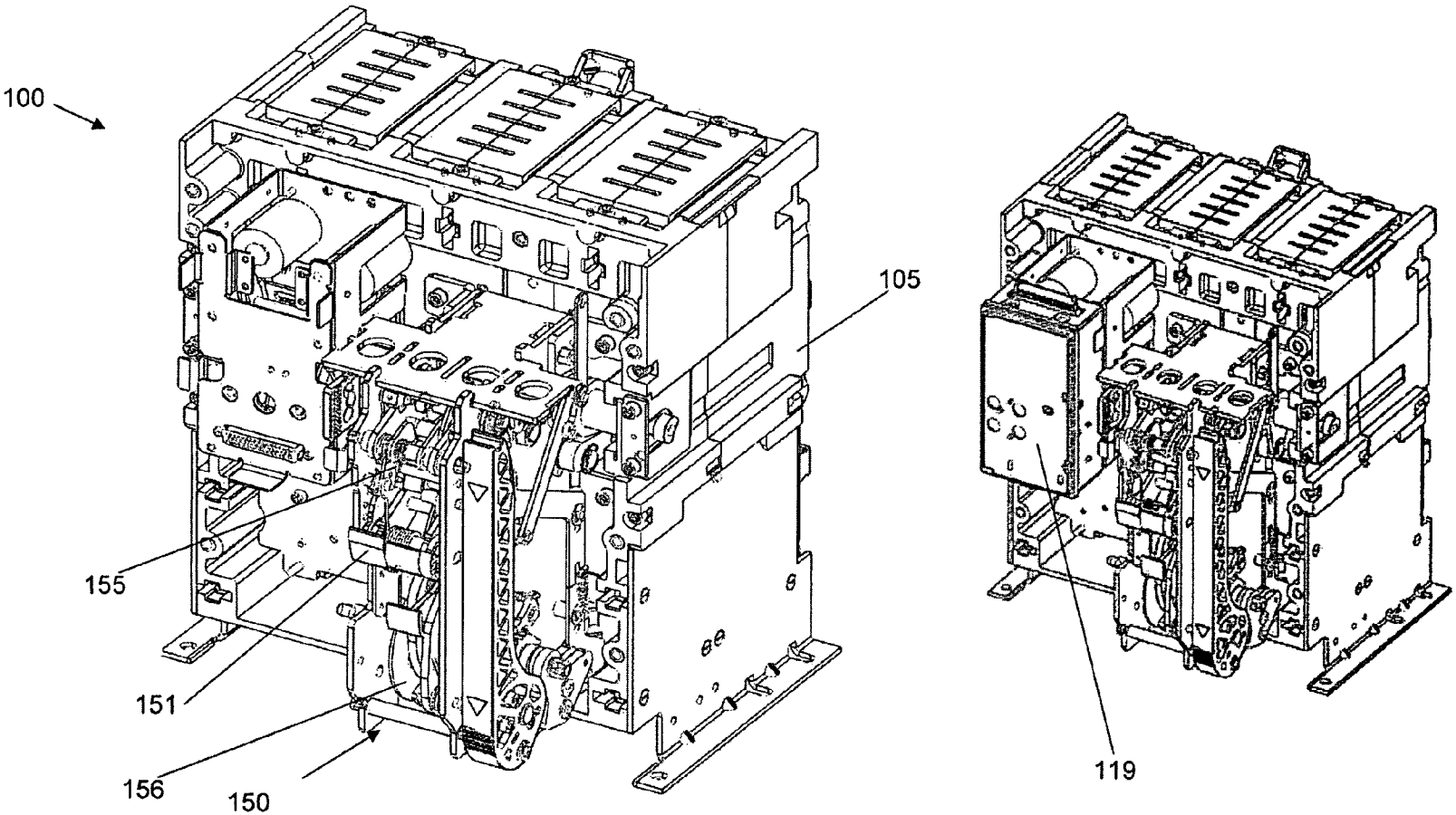
FIG. 1A illustrates a front perspective view of a circuit breaker assembly in accordance with exemplary embodiments.
Figure 1B:
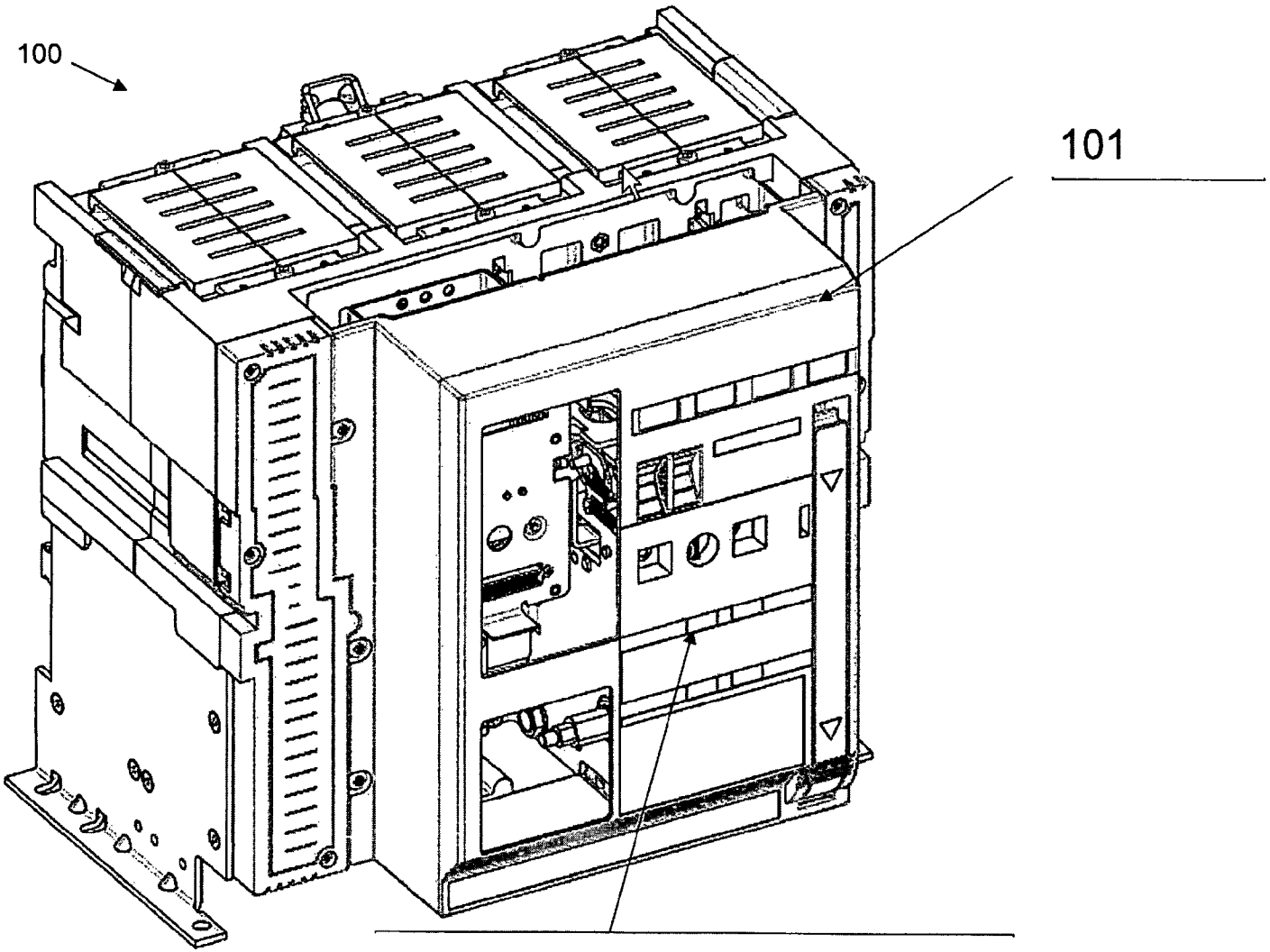
FIG. 1B illustrates a front perspective view of a circuit breaker assembly in accordance with exemplary embodiments.

FIG. 1A illustrates a perspective view of a circuit breaker assembly 100 in accordance with exemplary embodiments. The assembly 100 includes a breaker housing 105, a circuit breaker 150 disposed within the housing 105 and a lay shaft 163 disposed within the housing 105 and coupled to the circuit breaker 150. The assembly 100 further includes a trip unit 119 shown assembled thereto. The assembly 100 is configured to allow current to flow through a circuit (not shown) in response to being in a closed configuration and to prevent current from flowing through the circuit in response to the assembly 100 being in an open configuration. In exemplary embodiments, the circuit breaker 150 further includes a "readiness to close" (RTC) indicator 151 coupled to a trip free plate 155. In exemplary embodiments, the circuit breaker 150 further includes a charging cam assembly 170 having a RTC cam 156 coupled to the RTC indicator 151 as further described herein. As discussed above, the RTC indicator 151 can indicate a "ready to close" condition of the circuit breaker when the above-discussed criteria has been met as now described in accordance with exemplary embodiments. FIG. 1B illustrates a front perspective view of a circuit breaker assembly in accordance with exemplary embodiments. In this view, the circuit breaker assembly 100 includes a front cover 101 in which the RTC indicator 151 can be viewed through an RTC indicator opening 102.

Figure 1D:
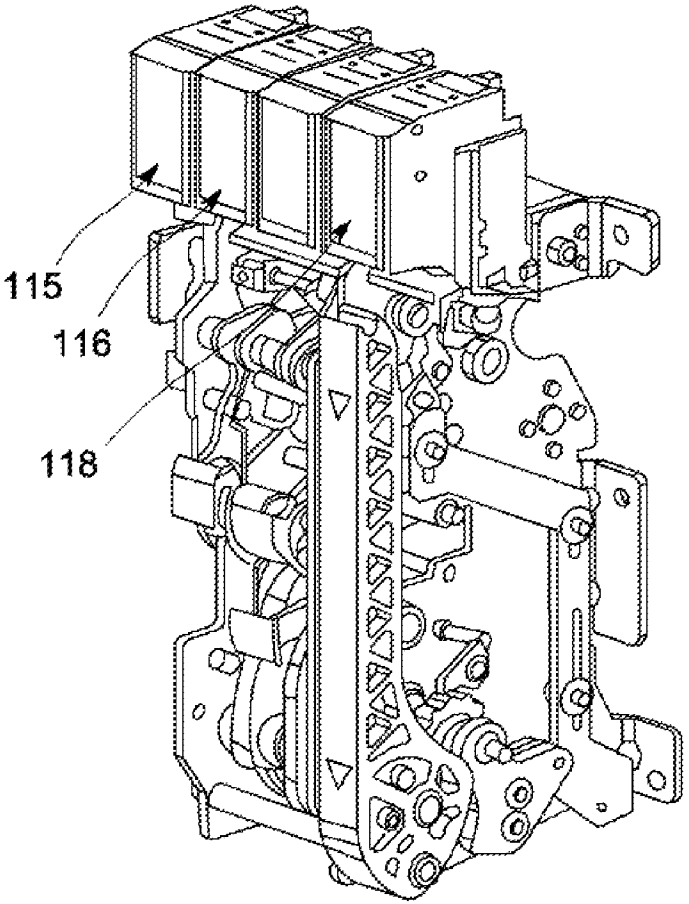
FIG. 1D illustrates an perspective front view of an exemplary circuit breaker.
Figure 1C:
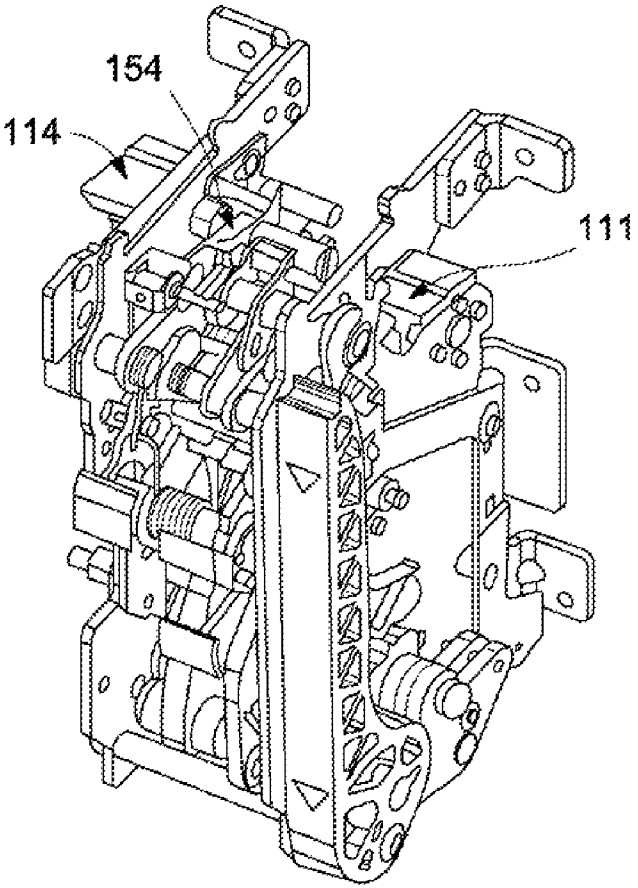
FIG. 1C illustrates an perspective front view of an exemplary circuit breaker.
Figure 1E:
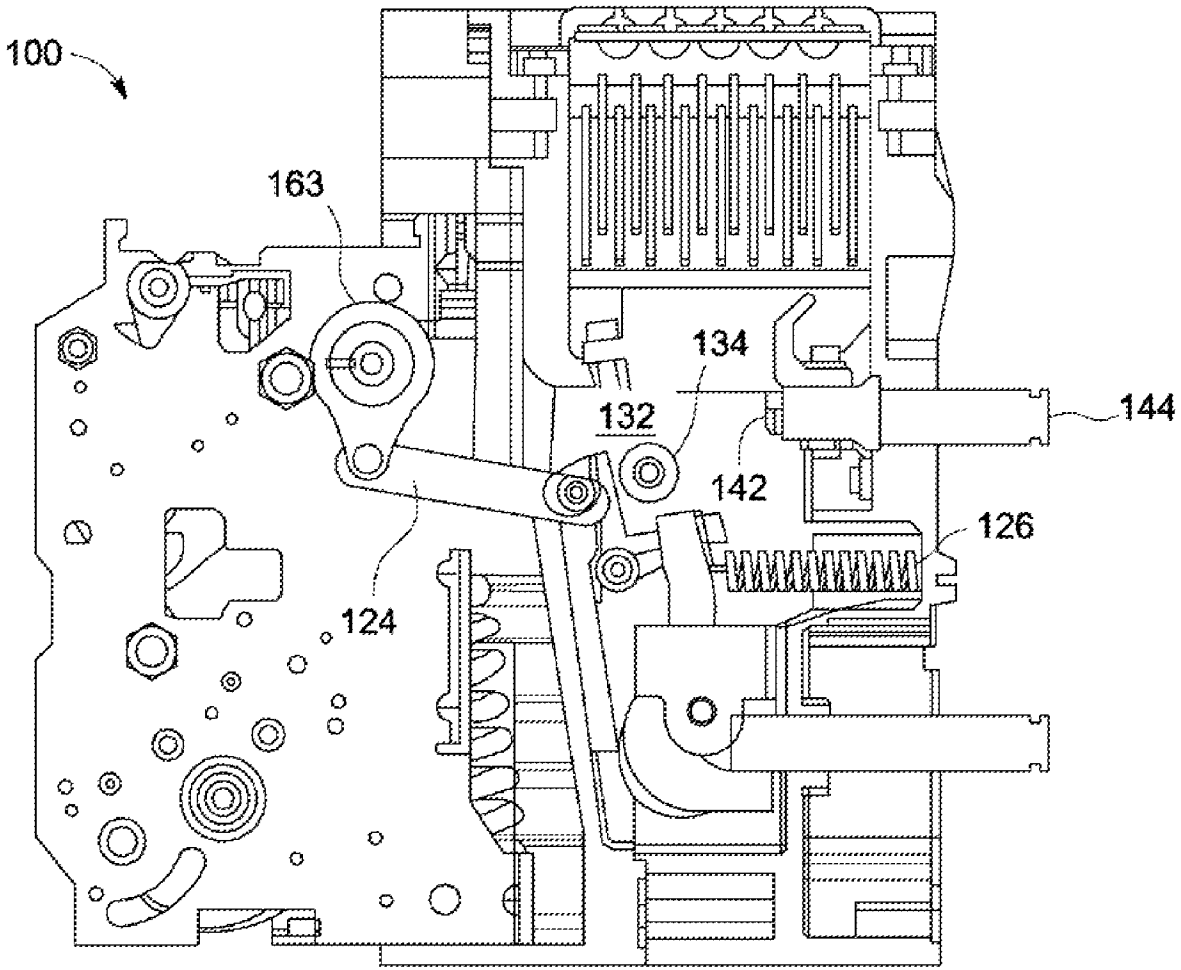
FIG. 1E illustrates a side view of a circuit breaker assembly in accordance with exemplary embodiments.
Figure 2A:
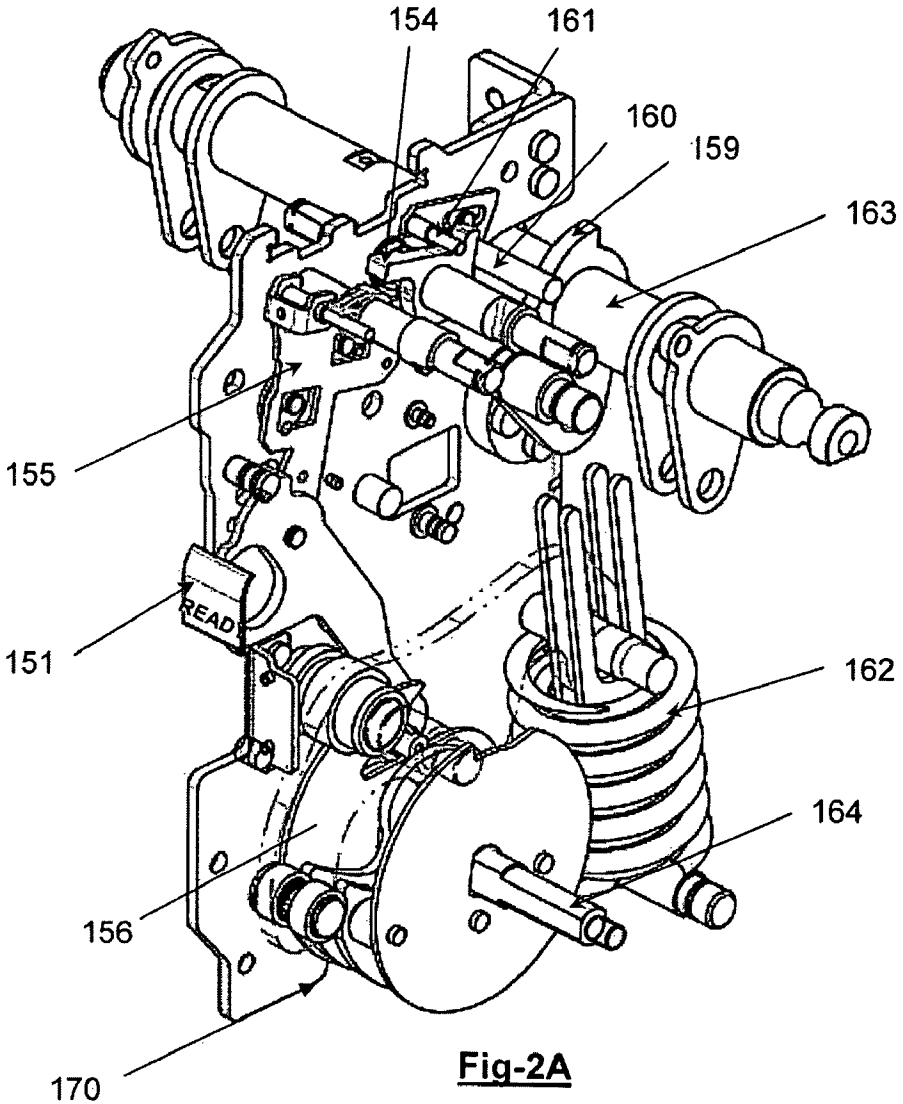
FIGS. 2A-2D illustrate multiple views of a circuit breaker in a condition of breaker charged and contacts open condition in accordance with exemplary embodiments.
Figure 2D:
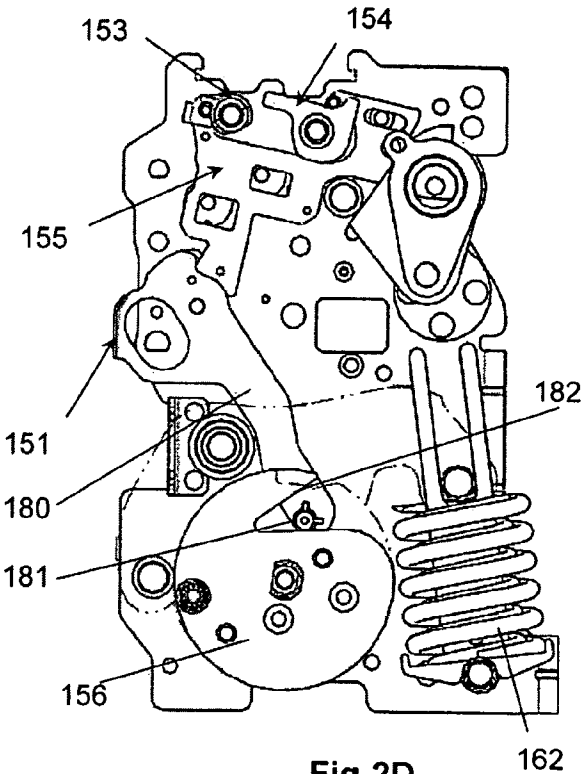
Figure 2C:
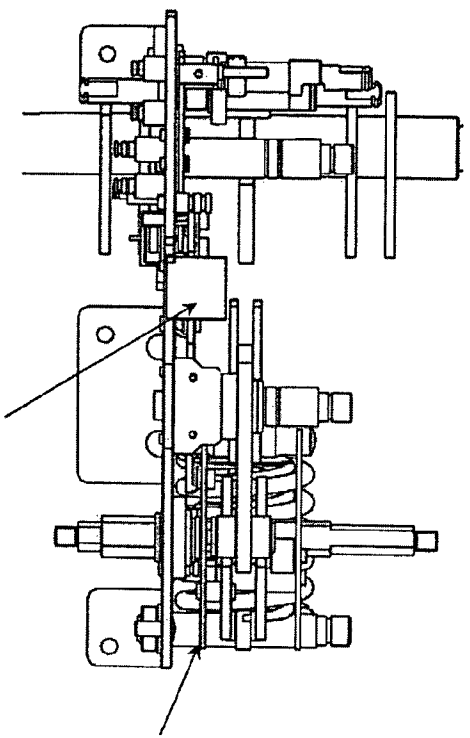
Figure 2B:
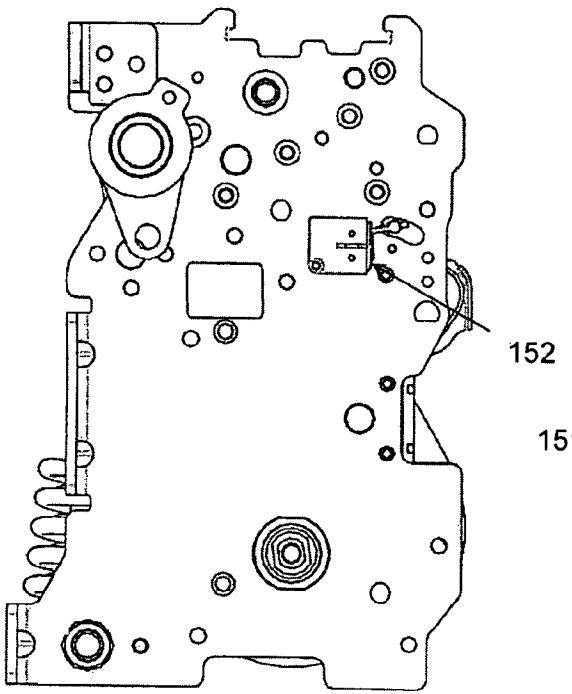

FIGS. 1C-1D illustrate perspective front views of the exemplary circuit breaker 150. In exemplary embodiments, the circuit breaker 150 includes an opening coil interface 111,154,114, which can be referred to as a trip paddle, collectively, which is coupled to a trip shaft. The opening coil 115, 116, 118 can be either a shunt coil or a under voltage coil. Normally, a shunt coil is implemented for opening the circuit breaker 150 and an under voltage coil is implemented for checking the breaker voltage, and if the voltage is not with in the range then the under voltage coil opens the circuit breaker 150. An interlock can also be applied via the above-described coils. For applying an interlock, the shunt coil has to be powered. The shunt coil plunger pushes the trip paddle down and keeps the circuit breaker in a not ready close condition. Normally, the under voltage coil has to be energized for keeping the circuit breaker in a ready to close condition. For applying the interlock, the under voltage coil is not energized. As such, the under voltage coil plunger pushes the trip paddle and keeps the circuit breaker in a not ready to close condition FIG. 1E illustrates a side view of a circuit breaker assembly 100 in accordance with exemplary embodiments. As illustrated the circuit breaker 150 is operatively coupled to a moving finger 132 via a coupler 124 and lay shaft 163 (described further herein). In exemplary embodiments, the moving finger is held in place by a contact spring 126. In further exemplary embodiments a contact tip 134 disposed on the moving finger 132 is configured to engage a contact tip 142 disposed on a terminal 144.

Figure 7:
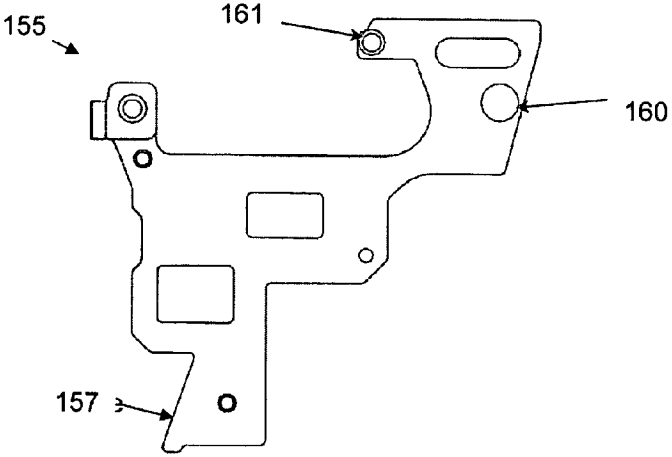
FIG. 7 illustrates a side view of a trip free plate in accordance with exemplary embodiments.

FIGS. 2A-2D illustrate multiple views of the circuit breaker 150 in a condition of breaker charged and contacts open (with the main spring 162 charged and compressed) condition in accordance with exemplary embodiments. Furthermore, the interlock, as discussed above, is not applied. In exemplary embodiments, the breaker charged condition includes a main breaker spring 162 being charged. In exemplary embodiments, the circuit breaker includes the RTC indicator 151 coupled to the trip free plate 155 and to the RTC cam 156. In exemplary embodiments, the RTC indicator 151 includes an RTC indicator arm 180 and cam pin 181 configured to engage a cam groove 182 disposed on the RTC cam 156. In exemplary embodiments, the trip free plate 155 includes a trip free rear pin 160 and a trip free front pin 161, as further illustrated in FIG. 7.

Still referring to FIGS. 2A-2D, in the above-described condition, the RTC indicator 151 is in a ready to close indicator active condition. In exemplary embodiments, the RTC indicator 151 is biased downward via a biasing member (not shown, e.g., a spring) and the cam pin 181 engages (i.e., drops into) the RTC cam groove 182. Furthermore, in this condition the RTC indicator 151 displays the status of "ready to close". In exemplary embodiments, the RTC indicator is coupled to a micro-switch 152 (see FIG. 2B). In this condition, the RTC indicator 151 also activates the micro switch 152, which, in turn is implemented as an electrical indication of "ready to close". In exemplary embodiments, the micro switch 152 NO/NC contacts can be implemented as an electrical indication. At a RTC active condition, the micro switch 152 contacts are closed and vice versa for an RTC inactive condition.

Figure 3C:
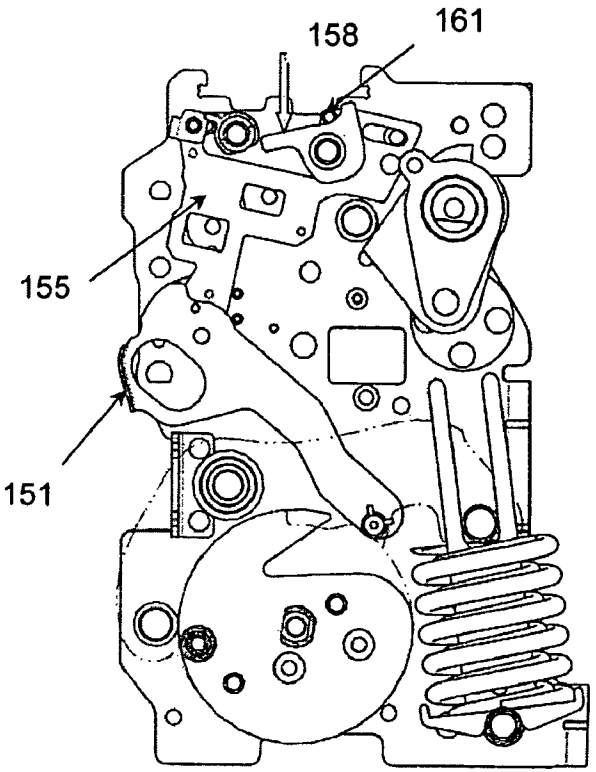
FIGS. 3A-3C illustrate multiple view of a circuit breaker in a condition of breaker charged, contacts open condition and trip coil activated in accordance with exemplary embodiments.
Figure 3B:
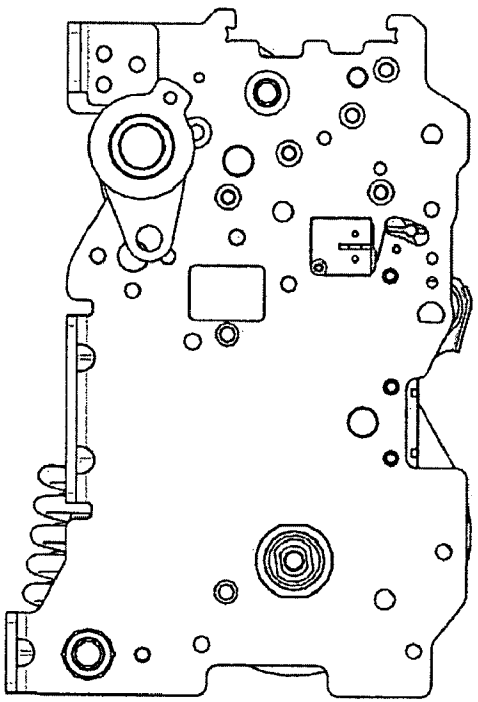
Figure 3A:
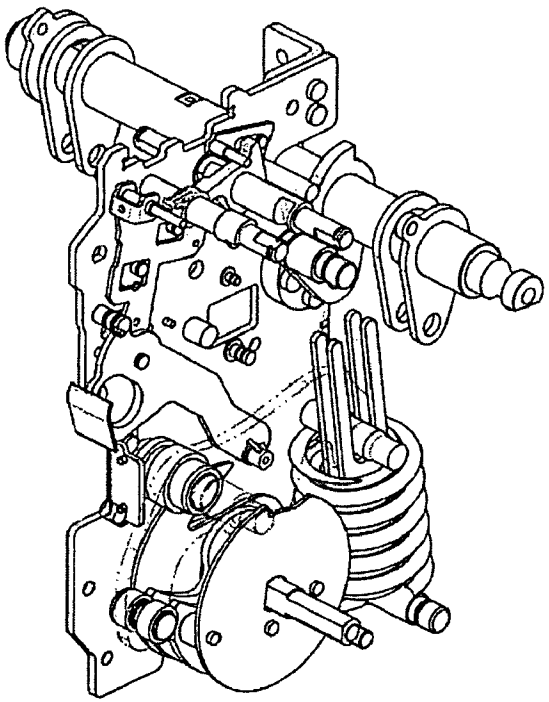

FIGS. 3A-3C illustrates multiple views of the circuit breaker 150 in a condition of breaker charged, contacts open (with the main spring 162 charged and compressed) condition and trip coil activated in accordance with exemplary embodiments. In this condition, the RTC indictor is in a ready to close indicator inactive condition. In exemplary embodiments, in this condition the trip paddle 154 is pushed down as indicted by directional arrow 158 as an indictor that the trip coil (not shown) has been activated. Furthermore, the interlock is applied as via the trip coil. Furthermore, the trip paddle 154 engages and pushes the trip free plate 155 via trip free front pin 161. In exemplary embodiments, in response to the resultant movement of the trip free plate 155, the trip free cam profile 157 (see also FIG. 7) also moves, thereby engaging and rotating the RTC indicator 151. The resultant movement of the RTC indicator 151 hides the "ready to close" insignia indication from the user. The movement of the RTC indicator 151 also prevents activation of the micro-switch 152. Furthermore, the RTC indicator 151 is biased downward via a biasing member (not shown, e.g., a spring) and the cam pin 181 dis-engages (i.e., is raised from) the RTC cam groove 182.

Figure 4C:
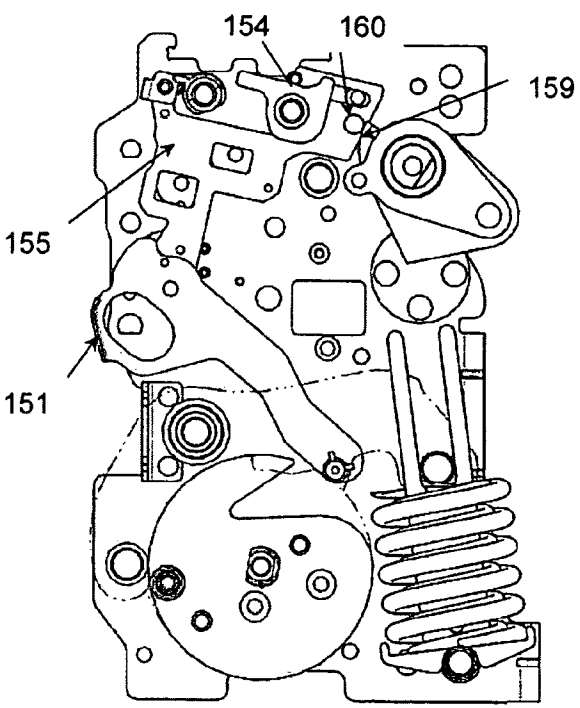
FIGS. 4A-C illustrate multiple views of a circuit breaker in a condition of breaker charged and contacts closed condition in accordance with exemplary embodiments.
Figure 4B:
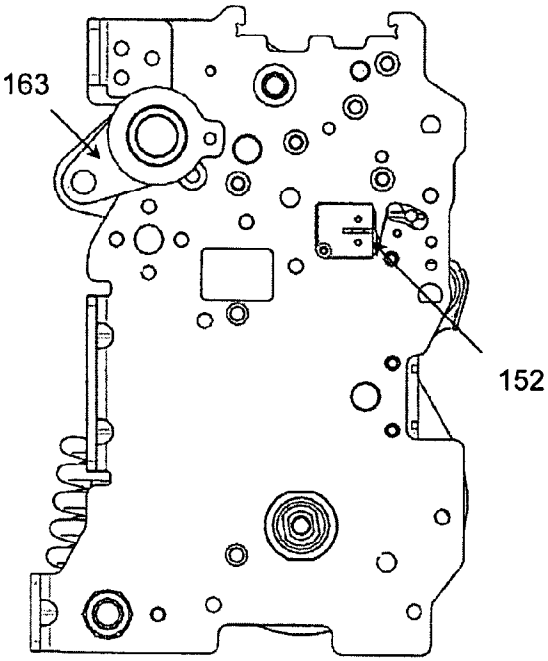
Figure 4A:
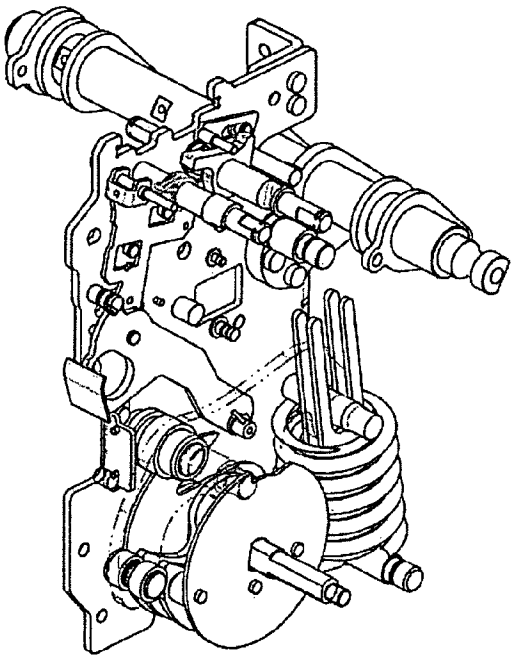

FIGS. 4A-4C illustrate multiple views of a circuit breaker in a condition of breaker charged and contacts closed (with the main spring 162 charged and compressed) condition in accordance with exemplary embodiments. In this condition, the lay-shaft cam profile 159 of the lay shaft 163 engages and pushes the trip free plate 155) via the trip free rear pin 160. In exemplary embodiments, due to this movement the trip free cam profile 157 rotates the RTC indicator 151 and prevents RTC indicator 151 from displaying the "ready to close" insignia and which, in turn, prevents the activation of the micro-switch 152 as described above. Furthermore, the cam pin 181 dis-engages (i.e., is raised from) the RTC cam groove 182. However, the RTC indictor is in a ready to fall condition in which the cam pin 181 is ready to fall into the RTC cam groove 182. However, the RTC indicator is blocked to the fall condition by the trip free cam profile 157 in which the cam pin 181 is blocked to fall in to the groove 182 by the trip free cam profile 157.

Figure 5C:
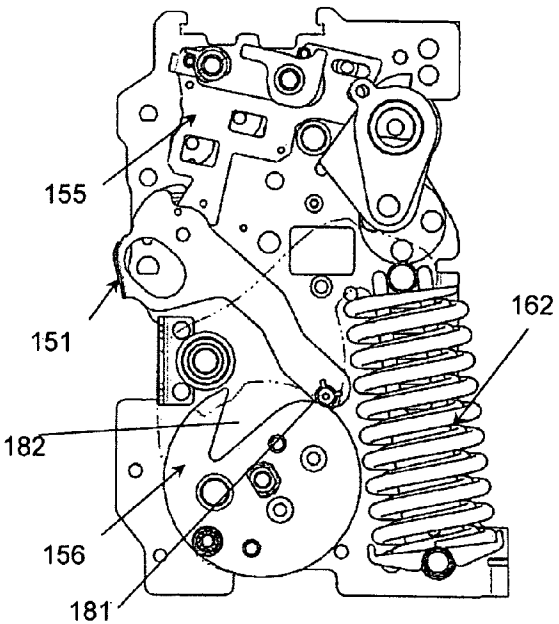
FIGS. 5A-5C illustrate multiple views of a circuit breaker in a condition of breaker discharged and contacts open condition in accordance with exemplary embodiments.
Figure 5B:
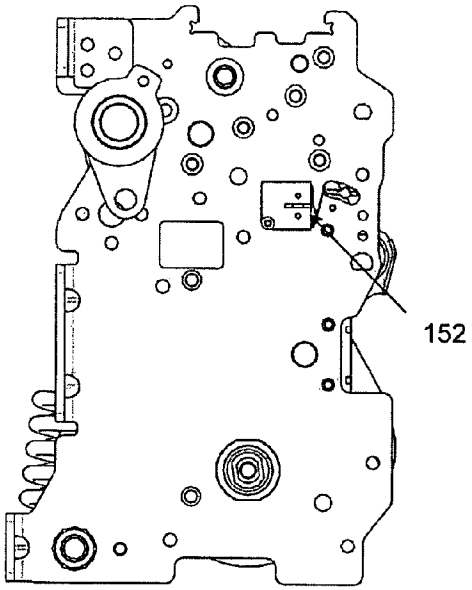
Figure 5D:
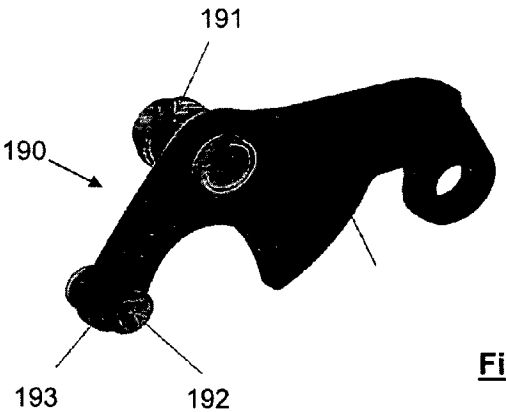
FIG. 5D illustrates a side view of an exemplary closing cam plate.
Figure 5A:
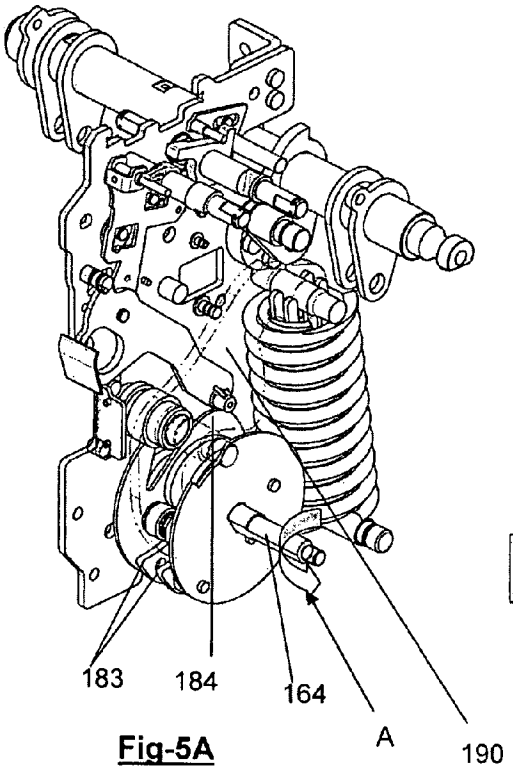
Figure 5D:
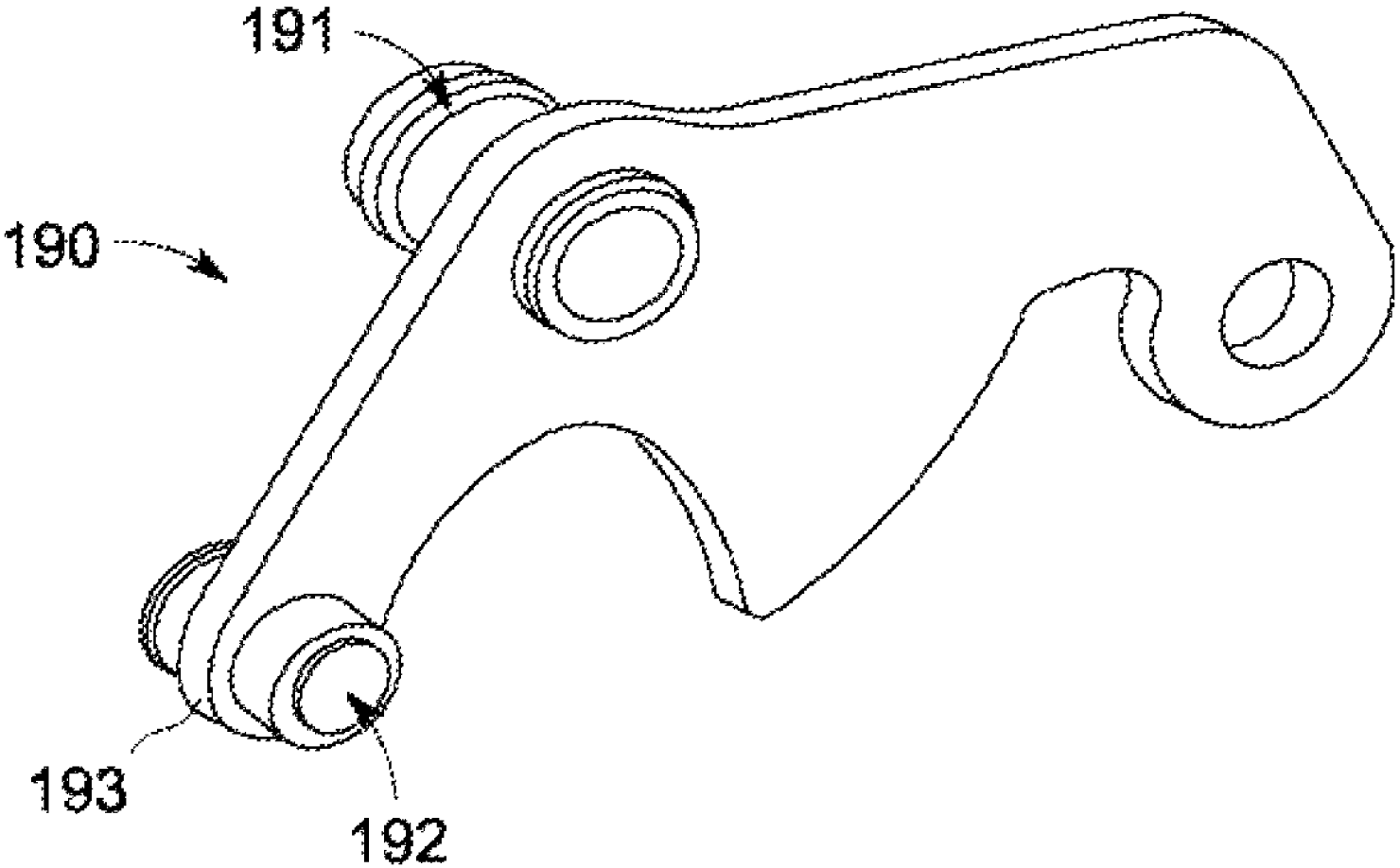
Figure 6B:
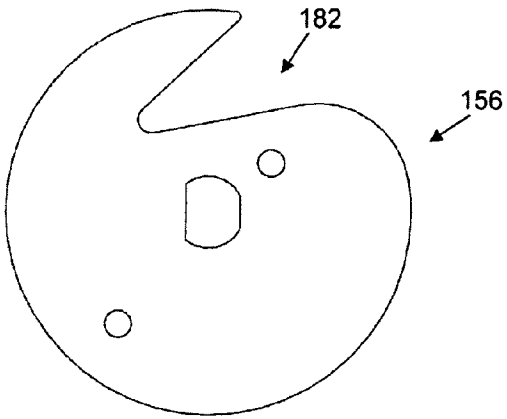
FIG. 6B illustrates a side view of a ready to close cam in accordance with exemplary embodiments.
Figure 8:
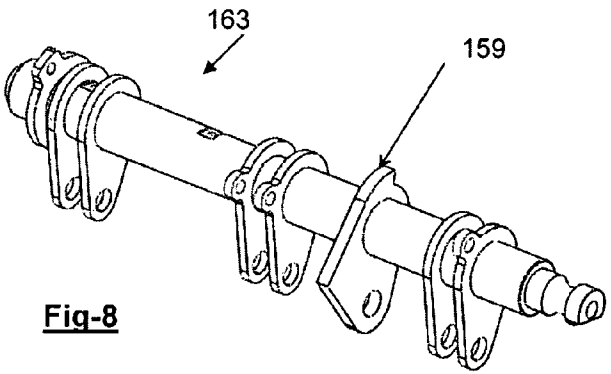
FIG. 8 illustrates a perspective view of a lay shaft having a lay shaft cam profile in accordance with exemplary embodiments.
Figure 6A:
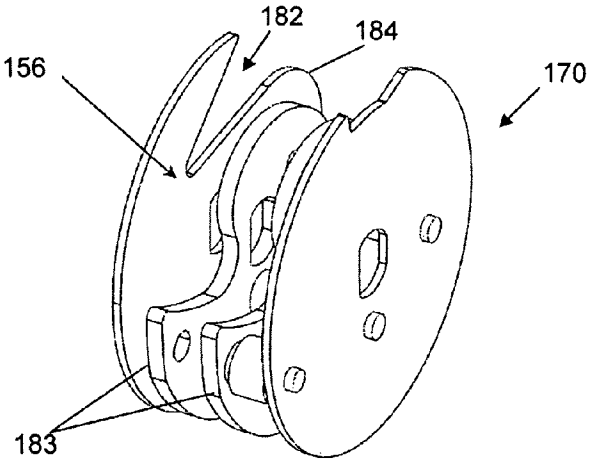
FIG. 6A illustrates a side perspective view of a charging cam assembly in accordance with exemplary embodiments.

FIGS. 5A-5C illustrate multiple views of a circuit breaker in a condition of breaker discharged and contacts open (with the main spring 162 dis-charged and extended) condition in accordance with exemplary embodiments. In this condition, the RTC indictor is in a ready to close indicator in-active condition, and the interlock is not applied. In this condition, the RTC cam is rotated thereby preventing the cam pin 181 from falling into the cam groove 182. As such, the RTC cam 156 prevents the RTC indicator 151 from showing the "ready to close" insignia and which, in turn, prevents the activation of micro-switch 152. In exemplary embodiments, when the circuit breaker 150 closes (i.e., discharges) the charging cam assembly 170 rotates and the RTC cam groove 182 lifts the RTC indicator 151. Thus the RTC indicator 151 is rotated. FIG. 5C illustrates the cam pin 181 resting on the RTC cam 156 outside the RTC cam groove 182. FIG. 5A further illustrates that the charging cam assembly 170 includes a charging cam 183 and a closing cam plate 190 coupled to the charging cam assembly 170. FIG. 5D illustrates a side view of an exemplary closing cam plate 190 including a closing cam plate bushing 191 a closing cam rivet pin 192 and a closing cam roller 193. In exemplary embodiments, a charging operation of the charging cam assembly 170 includes rotating the cam shaft 164 as illustrated by arrow A counterclockwise by a handle or motor (not shown). A cam profile 184 interacts with the closing cam roller 193 when cam shaft 164 is rotated, which, in turn, rotates the closing cam plate 190 in a clockwise direction there by compressing the spring 162.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A circuit breaker apparatus, comprising: a lay shaft, coupled to circuit breaker contacts;

a lay shaft cam profile coupled to the lay shaft;

a trip free plate coupled to the lay shaft cam profile;

a trip paddle coupled to the trip free plate, wherein the trip paddle is coupled to a trip shaft; and a circuit breaker main spring operatively coupled to a charging cam assembly;

a ready to close indicator coupled to the trip flee plate and charging cam assembly;

a shunt coil operatively coupled to the ready to close indicator via the trip paddle and the trip free plate; and an undervoltage (UV) coil operatively coupled to the ready to close indicator via the trip paddle and the trip free plate.

2. A circuit breaker apparatus, comprising:

a lay shaft coupled to circuit breaker contacts;

a lay shaft cam profile coupled to the lay shaft;

a trip free plate coupled to the lay shaft cam profile;

a trip paddle coupled to the trip free plate, wherein the trip paddle is coupled to a trip shaft;

a ready to close indicator coupled to the trip free plate and a charging cam assembly;

wherein the charging cam assembly includes a ready to close cam having a cam groove;

wherein the ready to close indicator comprises:

a ready to close indicator arm; and a cam pin disposed on the ready to close indicator arm; and wherein the cam pin is configured to fall into the cam groove in response to the circuit breaker being in a ready to close condition.

3. The apparatus as claimed in claim 1 wherein the cam pin is configured to remain out of the cam groove in response to the circuit breaker being in a not ready to close condition.

4. The apparatus as claimed in claim 3 wherein the ready to close cam is configured to prevent the cam pin from falling into the ready to close cam groove in response to the circuit breaker apparatus being in a not ready to close condition due to a breaker closing spring being in a not energized condition.

5. The apparatus as claimed in claim 3 wherein the trip fee plate is configured to prevent the cam pin from falling into the ready to close cam groove in response to the circuit breaker apparatus being in a not ready to close condition due to the circuit breaker apparatus being interlocked.

6. The apparatus as claimed in claim 3 wherein the trip free plate is configured to prevent the cam pin from falling into the ready to close cam groove in response to the circuit breaker apparatus being in a not ready to close condition due to the circuit breaker contacts being in an OFF condition.

* * * * *

UNITED STATES PATENT AND TRADEMARK OFFICE

CERTIFICATE OF CORRECTION

PATENT NO. : 7,906,740 B2
APPLICATION NO. : 12/103056
DATED : March 15, 2011
INVENTOR(S) : Gopikrishnan Babu et al.

It is certified that error appears in the above-identified patent and that said Letters Patent is hereby corrected as shown below:

In Column 5, Line 18, in Claim 1, delete "flee" and insert -- free --, therefor.

In Column 6, Line 12, in Claim 3, delete "claim 1" and insert -- claim 2 --, therefor.

In Column 6, Line 20, in Claim 5, delete "fee" and insert -- free --, therefor.

Signed and Sealed this
Thirteenth Day of September, 2011

David J. Kappos

David J. Kappos
*Director of the United States Patent and Trademark Office*